United States Patent [19]

Kondo et al.

[11] Patent Number: 4,812,138

[45] Date of Patent: Mar. 14, 1989

[54] CONNECTOR TERMINAL

[75] Inventors: Hiroki Kondo; Hiroaki Saito; Makoto Katsumata; Michitaka Kinoshita, all of Shizuoka, Japan

[73] Assignee: Yazaki Corporation, Tokyo, Japan

[21] Appl. No.: 137,199

[22] Filed: Dec. 23, 1987

[30] Foreign Application Priority Data

Feb. 12, 1987 [JP] Japan ..... 62-283553

[51] Int. Cl.[4] ..... H01R 4/18

[52] U.S. Cl. ..... 439/865; 174/84 C

[58] Field of Search ..... 439/865–868, 439/877–882; 174/84 C, 90

[56] References Cited

U.S. PATENT DOCUMENTS 2,815,497 12/1957 Redslob ..... 174/90

FOREIGN PATENT DOCUMENTS 2844001 5/1980 Fed. Rep. of Germany ..... 439/880

OTHER PUBLICATIONS

Electrical Connectors article, "Reliable Electrical Connections", pp. 31–34, 1958.

IBM Tech. Disclosure Bulletin, "Wire Barrel Connector", vol. 8, No. 10, Mar, 1966.

*Primary Examiner*—Gary F. Paumen

*Attorney, Agent, or Firm*—Robbins & Laramie

[57] ABSTRACT

A connector terminal is disclosed which comprises a base plate having an electrical contact portion at one side and an electrical wire connecting portion at the other side, and a pair of wire barrel members extending upwardly from both edges of the base plate so that a conductor of an electrical wire is crimped by the pair of wire barrel members. A CH CW ratio in the electrical wire pressure contact portion is in the range of 31 to 35%, the CH CW ratio being defined by the following equation:

$$CH \cdot CW \text{ ratio} = \frac{CH}{CH + CW} \times 100(\%),$$

where CH is the crimp height and CW is the crimp width.

6 Claims, 6 Drawing Sheets

2
7
4
8

CONNECTOR TERMINAL

BACKGROUND OF THE INVENTION

1. Field of the Invention

The present invention relates to a connector terminal having, at a pressure contact portion connected to an electrical wire, characteristics such that a contact resistance is small and the connection is stable even at a high temperature.

2. Prior Art

In general, a connector terminal used for connecting an automotive wire harness or the like is made of a base plate that has an electrical contact portion at its front side and an electrical wire connecting portion at its rear side. A conductor of an electrical wire and an insulating coating thereon are pressed by a pair of wire barrels and a pair of insulator barrels each extending upwardly from both edges of the base plate, respectively. Methods for connecting the connector terminal and the electrical wire, such as a W-shape contact pressure method, a C-shape contact pressure method, an F-shape contact pressure method, a soldering method and the like are widely used for mass production.

The contact resistance and the electrical wire fixing force are representative of basic characteristics which show the quality of the connection according to the F-shape contact pressure method. These values are changed in accordance with the cross-sectional shape of the connection. The cross-sectional shape of the connection may be represented by a crimp height (CH) and a crimp width (CW) during the pressing operation. Although it is preferable to set the crimp height CH in a stable region of the contact resistance, it is necessary to take into consideration the strength of a neck portion of the terminal and a breakdown due to vibrations. On the other hand, in an electrical wire fixing force curve, if the crimp height CH is greater than its maximum value, the electrical wire will be pulled apart from the terminal, whereas if the crimp height CH is smaller than the maximum value, the electrical wire will be broken down.

In view of the above-described phenomenon, according to the F-shape connecting method for the conventional connector, a CH CW ratio represented by the following equation has long been selected to be about 40%.

$$CH \cdot CW \text{ ratio} = \frac{CH}{CH + CW} \times 100(\%)$$

From various experiments and studies, it has been found that the F-shaped contact pressure method suffers from the disadvantage that the contact resistance of the contact pressure portion is increased in the high temperature atmosphere.

SUMMARY OF THE INVENTION

Accordingly, an object of the present invention is to provide a connector terminal having an electrical wire pressure contact structure which shows stable charcteristics even in a high temperature atmosphere in view of the heat generation problem of a large current circuit and which has been needed for use in conjunction with a large capacity alternator and the increased number of low current circuits due to the greater use of electronics in automotive vehicles.

In order to solve the problems described before, factors that influence the characteristics of the pressure contact portion of the connector terminal (i.e., the contact resistance and electrical wire fixing force) are taken into consideration, and analyses based upon a so-called design experiment are used. As a result of extensive studies, the CH.CW ratio is set in the range of 31 to 35%, so that there is provided a connector terminal which has a large electrical wire fixing force, a small contact resistance and stability even at a high ambient temperature.

According to the present invention, there is provided a connector terminal which comprises a base plate having an electrical contact portion at one side and an electrical wire connecting portion at the other side, and a pair of wire barrel members extending upwardly from both edges of the base plate so that a conductor (wire elements) of an electrical wire is crimped by the pair of wire barrel members. A CH.CW ratio in an electrical wire pressure contact portion is in the range of 31 to 35%, the CH.CW ratio being defined by the following equation:

$$CH \cdot CW \text{ ratio} = \frac{CH}{CH + CW} \times 100\%,$$

where CH is the crimp height and CW is the crimp width.

DETAILED DESCRIPTION OF THE INVENTION

The present invention will now be described with reference to the accompanying drawings.

Figure 1:
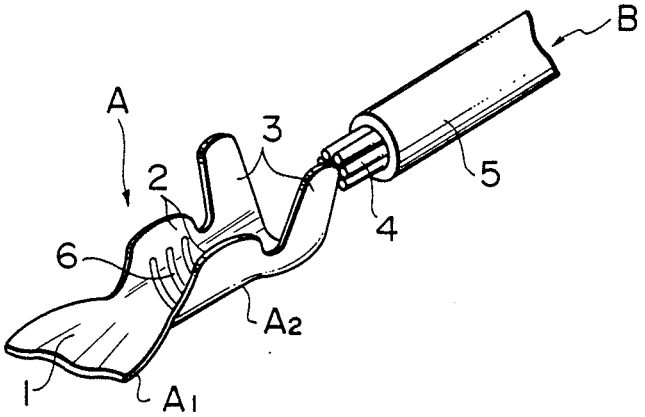
FIG. 1 is a perspective of a connector terminal in accordance with the invention.

FIG. 1 shows a connector terminal A to be used for connecting an automotive wire harness or the like, in which a base plate 1 has an electrical contact portion A1 at its front side and an electrical wire connecting portion A2 at its rear side. A conductor 4 and an insulating coating 5 of an electrical wire B are, respectively, pressingly contacted by a pair of wire barrel members 2 and a pair of insulator barrel members 3 each extending upwardly from both edges of the base plate 1, in the connecting portion A2. In an inner bottom of the pressure contact portion, there is provided a serration 6 for reinforcing the electrical wire fixing force.

Figures 2A, 2B, 2C:
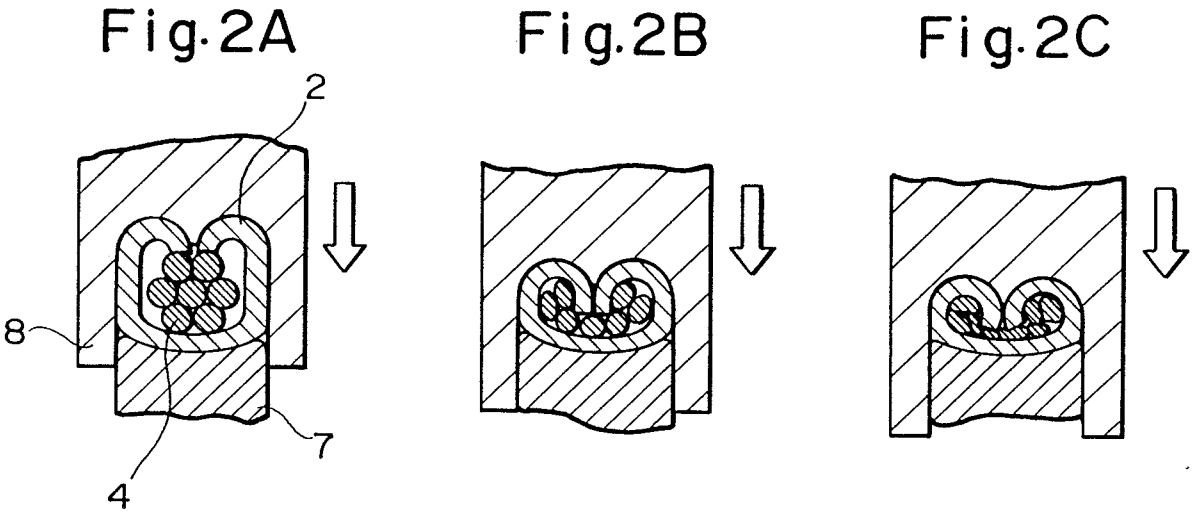
FIGS. 2A, 2B and 2C are views for illustrating the pressure contact process of the connector terminal shown in FIG. 1.

As described before, the F-shaped pressure contact method is most available for mass production as shown in FIGS. 2A, 2B and 2C. In FIGS. 2A, 2B and 2C, reference numeral 7 denotes an anvil, numeral 8 denotes a crimper and the arrow shows the crimping direction.

Figure 3:
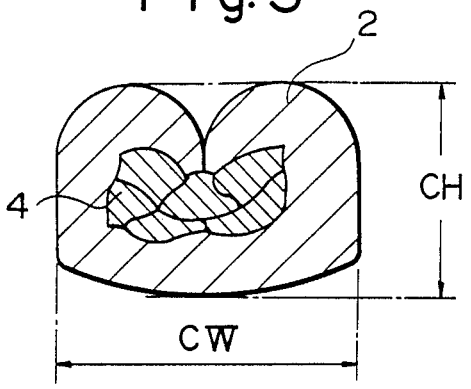
FIG. 3 is a cross-sectional view showing the pressure contact portion shown in FIG. 1.
Figure 8:
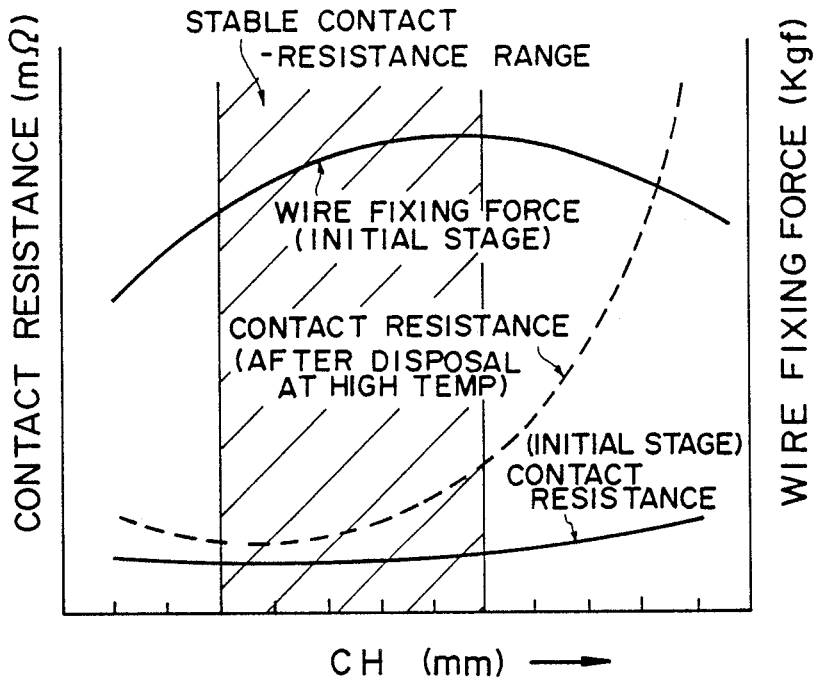
FIG. 8 is a graph showing contact characteristics of the conventional example.

As described before, the contact resistance and the electrical wire fixing force are used to represent the basic characteristics which show the quality of the contact pressure condition. These values are changed in accordance with the pressure contact configuration as shown by the pressure contact characteristic curve in FIG. 8. The pressure contact configuration is represented by a crimp height (CH) and a crimp width (CW) during the pressure contact as shown in FIG. 3. It is preferable to set the crimp height (CH) in the stable region of the contact resistance (hatched portion in FIG. 8). However, it is necessary to take into consideration the strength of the neck portion of the terminal and the breakdown of the electrical wire due to the vibrations. On the other hand, referring to the electrical wire fixing force curve, if the crimp height CH is greater than that corresponding to its maximum value, the electrical wire will be pulled apart from the terminal, whereas if the crimp height CH is smaller than that corresponding to the maximum value, the electrical wire will be broken down.

The factors which influence the quality of the pressure contact characteristics of the electrical wires, that is, the contact resistance and the electrical wire fixing force may involve the material thickness, the material quality, the wire barrel length, the kind of press machine used (cam type or hydraulic type), the use of a bellmouth and serration on the connector terminal, the use of press oil in the press machine, and the use of tin plating on the connector terminal.

An ordinary terminal material, such as KFC, C2600 or the like is used as the material of the connector terminal A. The thickness of the material and the wire barrel length are changed in accordance with a size of the connector terminal A and a diameter of an electrical wire to be connected. The use of press oil is undesirable in view of the increased contact resistance between the electrical wire conductor 4 and the wire barrels 2, but is needed for the press contact operation per se. Therefore, the amount of the press oil used should be decreased as much as possible. In order to reduce the respective contact resistances and to increase the electrical wire fixing force, it is preferable to provide the serration 6 on the inner bottom of the pressure contact portion and to apply a tinning to the base plate 1.

Figure 4:
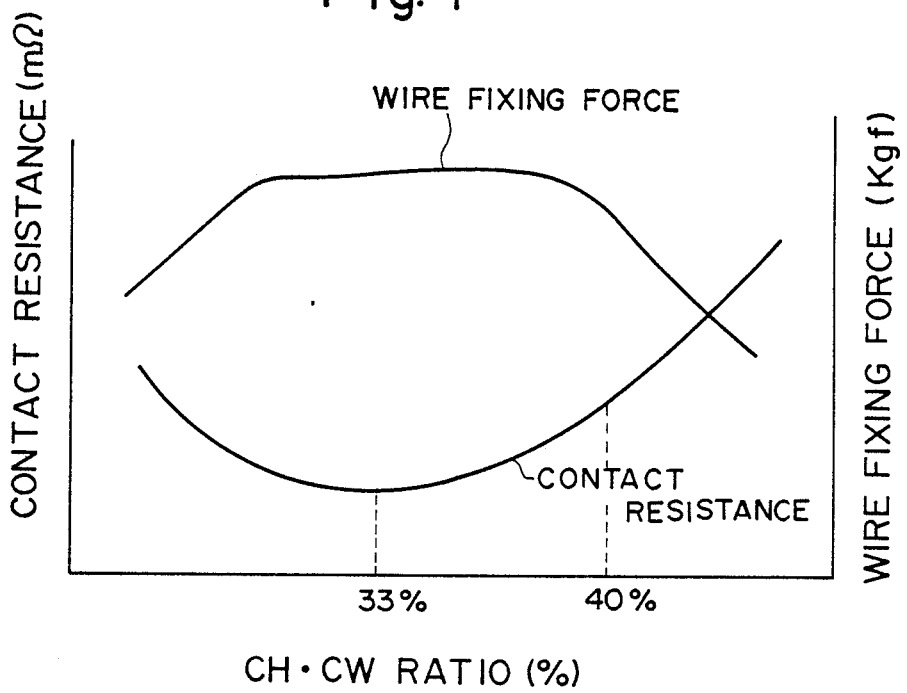
FIG. 4 is a graph showing the pressure contact characteristics showing one embodiment of the invention.

The CH.CW ratio is preferably in the range of 25 to 45%, and more preferably, is in the range of 31 to 35%. When the CH.CW ratio is about 33%, the contact resistance becomes the minimum value as shown in FIG. 4. However, in consideration of the stability of the electrical wire fixing force, according to the present invention, the CH.CW ratio at the pressure contact portion of the connector terminal is in the range of 31 to 35%. In comparison with a conventional case of the CH.CW ratio, the cross-sectional shape at the pressure contact portion according to the present invention is flat so that the contact area between the wire barrels of the terminal and the electrical wire conductor is increased, thereby reducing the contact resistance, enhancing the electrical wire fixing force and enhancing the electrical conductivity.

Also, according to the present invention, there is no press oil used for the press on the inner bottom portion of the pressure contact portion, an oxide film is removed from the terminal surface to provide a clean surface contact, and it is possible to reduce the contact resistance and to ensure stability at the high ambient temperature, as will be described later in more detail.

EXAMPLES

(1) Pressure Contact Characteristics

In accordance with an experimental method (so-called design experiment L16), the contact resistance and the electrical wire fixing forces of the connector terminals A shown in FIG. 1 were analyzed while selecting the factors and the standards that would influence the pressure contact characteristics. The results are shown in Table 1.

TABLE 1

| | Contact Resistance | | Electrical Wire Fixing Force | |
|---|---|---|---|---|
| Nos. | Significant Factors | Optimum Standards | Significant Factors | Optimum Standards |
| 1 | Tinning | Yes | Serration | Yes |
| 2 | Serration | Yes | Wire Barrel Length | 10.2 mm |
| 3 | Press Oil | No | Material Thickness | 0.4 mm |
| 4 | CH.CW Ratio | 33% | Material | C 2600 |
| 5 | Wire Barrel Length | 10.2 mm | CH.CW Ratio | 33% |
| 6 | Material | KFC | Press Oil | No |

From FIG. 1, it is apparent that the significant factors are identical with each other except for some cases according to the different characteristic factors with respect to the pressure contact characteristics.

Also, on the basis of the analyses, the relationship among the CH.CW ratio, electrical wire fixing force and contact resistance is shown in FIG. 4.

The measurement of the characteristic factors or values was conducted as follows.

(1) Contact Resistance

Figure 5:
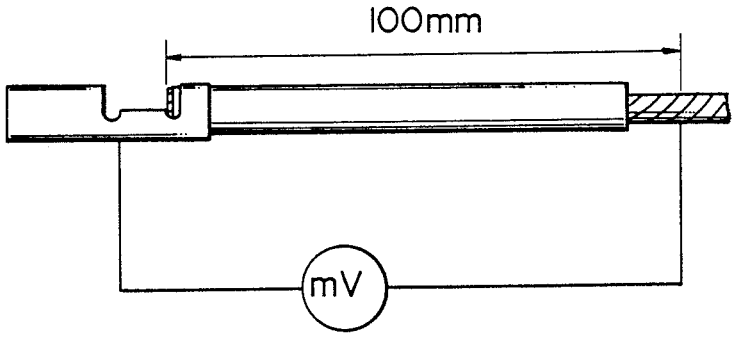
FIG. 5 is a view showing a measurement apparatus for measuring the contact resistance of the test pieces according to the present invention.

A circuit shown in FIG. 5 was produced, and a voltage drop of the circuit was measured at an open voltage 20 mV and short circuit current 10 mA. The electric resistance was subtracted therefrom.

(2) Electrical Wire Fixing Force

The load was masured when the electrical wire was pulled apart from the terminal or broken down under the conditions of a pulling speed of 200 mm/min and a chuck distance of 100 mm.

(2) Pressure Contact Characteristics In High Temperature Atmosphere

Factors that increase the contact resistance at the pressure contact portion of the connector in a high temperature atmosphere would be as follows:

(1) The contact pressure between the wire barrel inner portion and the electrical wire surface is reduced so that concentrated resistance due to stress moderation is increased.

(2) An insulating material is produced between the wire barrel inner portion and the electrical wire surface to increase the film resistance.

In order to confirm these factors, a mechanism of degradation was investigated by selecting two test pieces (A and B) that would have a good contact condition and a bad contact condition on the basis of the result of Table 1, as shown in Table 2. The contents are shown in Table 3.

TABLE 2

| Test Piece | Material thickness | Wire Barrel Length | Bell Mouth | Material | Serration | Oil | Tinning | CH.CW ratio |
|---|---|---|---|---|---|---|---|---|
| A | 0.32 mm | 10.2 mm | Yes | C 2600 | Yes | Yes | Yes | 33% |
| B | 0.32 mm | 10.2 mm | Yes | KFC | No | Yes | No | 33% |

TABLE 3

| Signs | Contents of Search | Degradation Modes |
|---|---|---|
| a | Change in Crystalline Granule | Increase in |
| b | Aging Change of Contact Section | Concentrated Resistance |
| c | High Temperature Disposal at Respective Temps. | (Stress Moderation) |
| d | Elemental Analyses of Damaged Samples | Increase of Film Resistance |

As a result, it was found that, with respect to the change of the crystalline granules before and after the high temperature disposal experiments (120° C.×500 h), the smaller the crimp height, the smaller the crystalline granule would become (due to the more remarkable working hardening or curing). Although the working stress would be concentrated onto the wire barrel tips and the bending worked portion, it was found that there was no change in crystalline granule between two test pieces A and B before and after the experiments.

Also, with respect to the aging change in pressure contact cross-section, there were no increases in gaps or voids in test piece A or B. There was no relationship between the contact resistance and the gaps or voids.

Figure 6:
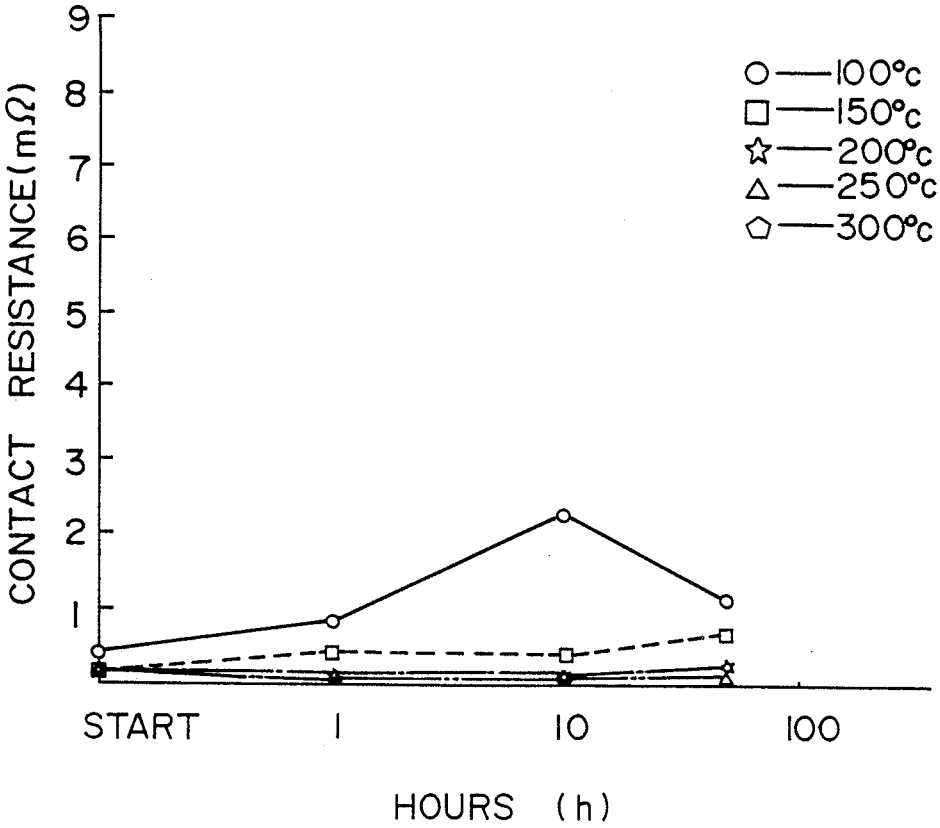
FIGS. 6 and 7 show the pressure contact characteristics embodiments of the invention.
Figure 7:
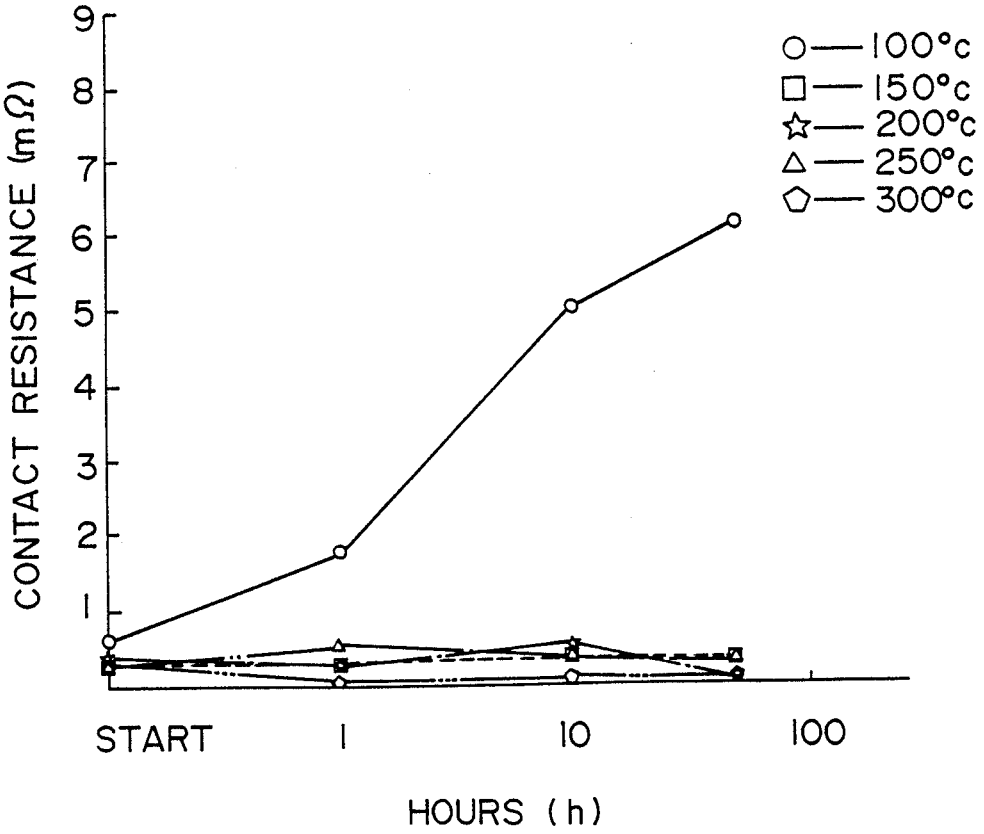

On the other hand, with respect to the high temperature disposal experiments according to a different temperature, the connector terminals to which the electrical wires were crimped had been disposed in the atmospheres kept at temperatures of 100° C., 150° C., 200° C., 250° C. and 300° C. Then, the aging change of the contact resistance were measured. The results were shown in FIG. 6 (test piece A) and FIG. 7 (test piece B), respectively. From FIGS. 6 and 7, it was apparent that both the test pieces A and B had small aging changes over the 150° C. but the degradation of the test piece B was remarkable in the 100° C. temperature atmosphere.

Subsequently, the element analyses of the damaged test pieces were conducted by using a wavelength dispersion type X-ray microanalyzer. The test pieces were those that had been subjected to the high temperature disposal experiments shown in FIGS. 6 and 7. The parts with serrations 6 as shown in FIG. 1 were selected as parts to be inspected for analyses. The results were shown in Table 4 in which the test pieces Nos. 4 and 8 were used in the above-described Example (1) entitled Pressure Contact Characteristics.

TABLE 4

| Nos. | Test Pieces | Durable Conditions | Wire Coating | Contact Resistance | Main Detected Elements |
|---|---|---|---|---|---|
| 1 | A | initial | No | 0.17 mΩ | C |
| 2 | | 100° C. × 50 h | No | 0.67 mΩ | C, 0 |
| 3 | | 200° C. × 50 h | No | 0.19 mΩ | C, 0 |
| 4 | | 120° C. × 500 h | Yes | 0.31 mΩ | C, 0 |
| 5 | B | initial | No | 0.20 mΩ | C |
| 6 | | 100° C. × 50 h | No | 6.12 mΩ | C |
| 7 | | 200° C. × 50 h | No | 0.28 mΩ | C, 0 |
| 8 | | 120° C. × 500 h | Yes | 20.2 mΩ | C, 0 |

As a result of the element analyses, the following facts were clarified.

(1) Carbon and oxygen were found as elements other than raw material and plating elements.

(2) A large amount of carbon was found in the test piece of 100° C.×50 h, and a small amount of oxygen was found.

(3) A large amount of oxygen was found in the test piece of 200° C.×50 h, and a small amount of carbon was found.

(4) With respect to test pieces A, there was a large amount of carbon in recesses of the serration. Also, on the tinned surface, there was locally a large amount of carbon but its distribution was in the form of spots.

(5) With respect to test pieces B, the carbon was detected over the surface in the initial condition, but after the disposal, the carbon was detected at parts where the wire barrels were in contact with the electrical wires.

(6) The element analysis results of the test pieces with electrical wire coating were the same as those of the test pieces from which the coating had been removed. There was no Cl (chlorine) produced from the coating.

As is apparent from the above results, the fact that a large amount of carbon was detected at the contact area of the pressure contact portions of the connector is mainly due to the increase of the carbon film resistance since the overall contact resistance would be high. However, according to the present invention the CH CW ratio is selected in the range of 31 to 35%, whereby the pressure contact characteristics are improved, and the conditions of tinning and serration are met whereby it is possible to suppress the increase of the contact resistance in the high temperature atmosphere (at 120° C.) to a minimum possible level (FIGS. 6 and 7) and the contact characteristics are stabilized.

We claim:

1. A connector terminal comprising a base plate having an electrical contact portion at one side and an electrical wire connecting portion at the other side, and a pair of wire barrel members initially extending upwardly from both edges of said base plate, a conductor of an electrical wire being subsequently crimped by said pair of wire barrel members, wherein a CH.CW ratio of an electrical wire pressure contact portion formed by said base plate and said wire barrel members after crimping is in the range of 31 to 35%, said CH.CW ratio being defined by the following equation:

$$CH \cdot CW \text{ ratio} = \frac{CH}{CH + CW} \times 100(\%),$$

where CH is the crimp height and CW is the crimp width.

2. The connector terminal according to claim 1 further comprising another pair of barrel members for crimping a coating of said electrical wire.

3. The connector terminal according to claim 1, wherein an inner bottom of said electrical contact portion includes at least one serration.

4. The connector terminal according to claim 1, wherein said connector terminal is tinned.

5. The connector terminal according to claim 1, wherein the CH.CW ratio is about 33%.

6. The connector terminal according to claim 1, wherein the electrical contact resistance of said connector terminal remains substantially unchanged above a temperature of 120° C. for at least 50 hours.

* * * * *